US007252149B2

(12) United States Patent
Crow

(10) Patent No.: US 7,252,149 B2
(45) Date of Patent: Aug. 7, 2007

(54) SAFETY VALVE LOCK OUT SYSTEM AND METHOD

(75) Inventor: Robert W. Crow, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 206 days.

(21) Appl. No.: 10/868,076

(22) Filed: Jun. 15, 2004

(65) Prior Publication Data

US 2005/0274529 A1 Dec. 15, 2005

(51) Int. Cl.
*E21B 34/06* (2006.01)

(52) U.S. Cl. ..... 166/373; 166/285; 166/323; 166/320

(58) Field of Classification Search ..... 166/373, 166/285, 323, 177.4, 320, 376
See application file for complete search history.

(56) References Cited

U.S. PATENT DOCUMENTS

| | | | | |
|---|---|---|---|---|
| 4,664,192 | A * | 5/1987 | Hogarth | 166/291 |
| 6,059,041 | A | 5/2000 | Scott | |
| 6,520,256 | B2 * | 2/2003 | Ferg | 166/285 |
| 2004/0084182 | A1 * | 5/2004 | Edgar et al. | 166/285 |

* cited by examiner

*Primary Examiner*—David Bagnell
*Assistant Examiner*—Nicole A Coy
(74) *Attorney, Agent, or Firm*—Marlin R. Smith

(57) ABSTRACT

A safety valve lock out system and method. In a described embodiment, a method of locking out a safety valve in a subterranean well includes the steps of: flowing a hardenable fluid into the safety valve; and preventing a closure device of the safety valve from closing with the hardenable fluid.

31 Claims, 4 Drawing Sheets

SAFETY VALVE LOCK OUT SYSTEM AND METHOD

BACKGROUND

The present invention relates generally to operations performed and equipment utilized in conjunction with a subterranean well and, in an embodiment described herein, more particularly provides a safety valve lock out system and method.

It is sometimes desirable to lock out a safety valve, that is, to render the safety valve inoperative by preventing it from closing. Typically, a safety valve is locked out permanently due to a malfunction. For example, a control line used to operate the safety valve may develop a leak or be severed, a flapper or other closure device of the safety valve may fail to close properly or seal adequately, etc. A safety valve may be locked out temporarily, for example, to permit unobstructed workover operations through the safety valve.

Prior methods of locking out safety valves have required complex mechanisms to open and secure the closure device. Some of these require an opening prong or flow tube of the safety valve to be displaced and locked in position.

It would, therefore, be beneficial to provide a way of locking out a safety valve which is relatively straightforward in design and execution, and which is not unnecessarily complicated, expensive or inconvenient to use.

SUMMARY

In carrying out the principles of the present invention, in accordance with an embodiment thereof, a safety valve lock out system and method are provided which prevent a safety valve from closing, and which do so in a convenient, economical and effective manner.

In one aspect of the invention, a method of locking out a safety valve in a subterranean well is provided. The method includes the steps of: flowing a hardenable fluid into the safety valve; and preventing a closure device of the safety valve from closing with the hardenable fluid.

In another aspect of the invention, a system for locking out a safety valve positioned in a subterranean well is provided. The system includes a container having a hardenable fluid therein, and a pump for transferring the hardenable fluid from the container to the safety valve. The hardenable fluid prevents a closure member of the safety valve from closing.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
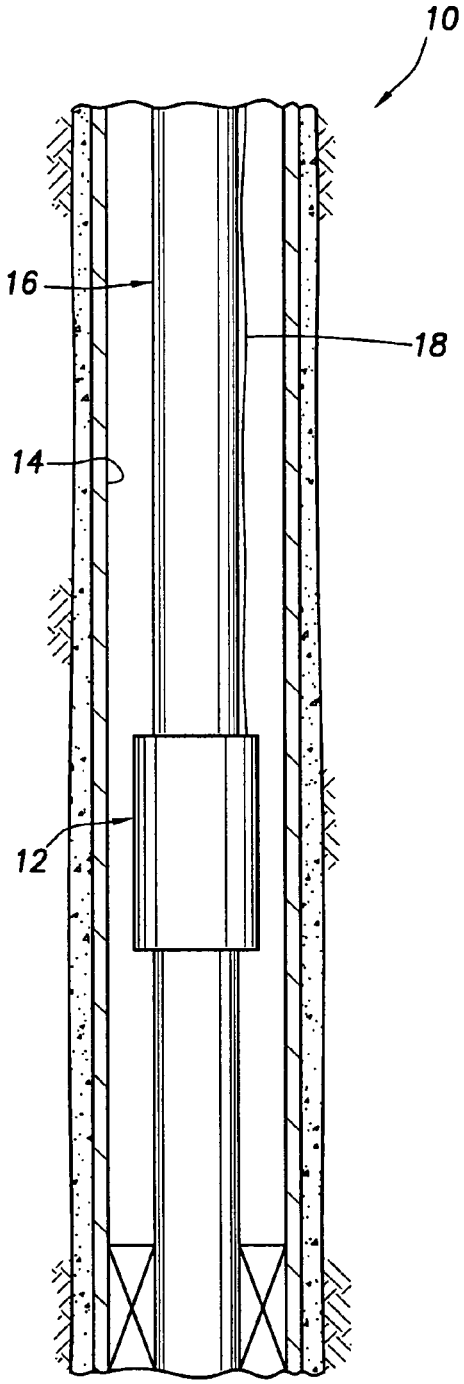
FIG. 1 is a schematic partially cross-sectional view of a safety valve lock out system embodying principles of the present invention.

Representatively illustrated in FIG. 1 is a safety valve lock out system 10 which embodies principles of the present invention. In the following description of the system 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

As depicted in FIG. 1, a safety valve 12 is positioned in a wellbore 14 of a well. In this example, the safety valve 12 is interconnected in a tubular string 16, such as a production tubing string. This type of safety valve is known to those skilled in the art as a tubing retrievable safety valve. However, it should be clearly understood that the principles of the invention are not limited to use with tubing retrievable safety valves.

A fluid conduit 18, such as a control line, extends from the safety valve 12 to a remote location, such as the earth's surface or a subsea wellhead, for operating the safety valve. Pressure may be applied to the conduit 18 to open the safety valve 12, and pressure may be released from the conduit to close the safety valve. Multiple control lines could be used, and other ways of operating the safety valve 12 may be used, without departing from the principles of the invention.

Figure 2:
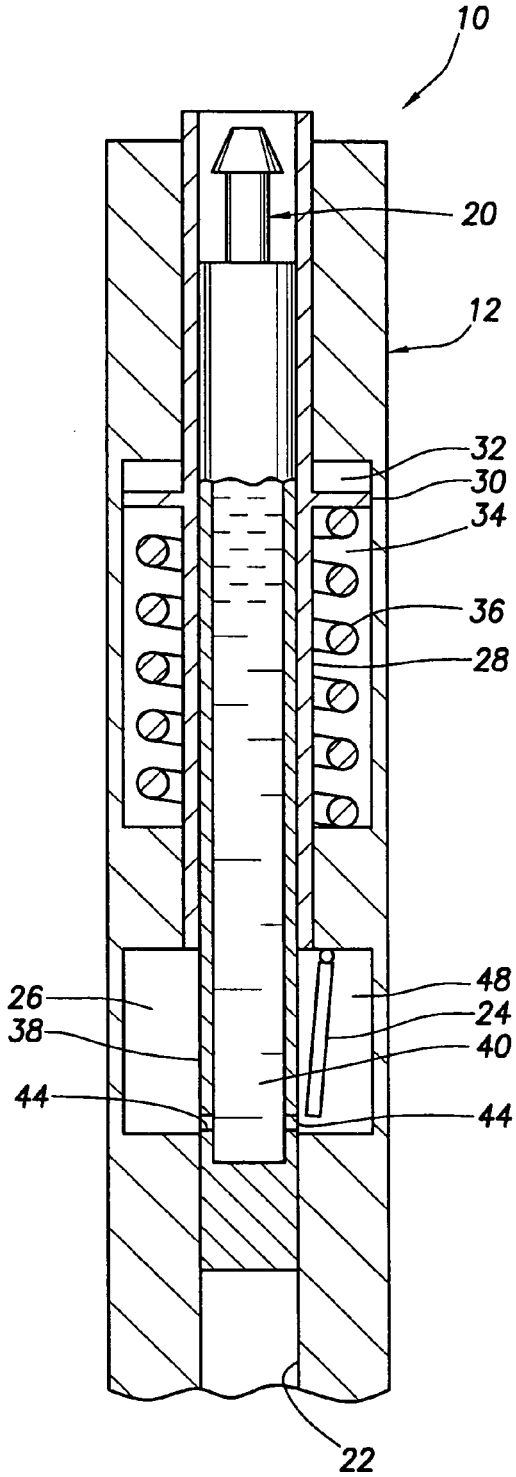
FIG. 2 is an enlarged scale schematic cross-sectional view of an initial step in a safety valve lock out method embodying principles of the invention.

Referring additionally now to FIG. 2, an enlarged schematic cross-sectional view of the safety valve 12 is representatively illustrated, apart from the remainder of the system 10. In this view, an initial step in a method of locking out the safety valve 12 may be seen. Specifically, a well tool 20 is conveyed into the safety valve 12 and positioned within an internal flow passage 22 of the safety valve.

The well tool 20 is depicted in FIG. 2 as a wireline-conveyed tool, but any means of conveyance could be used. For example, the well tool 20 could be conveyed by coiled tubing, segmented tubing, electric line, slickline, etc.

When the well tool 20 is conveyed into the safety valve 12, it may cause a closure device 24 of the safety valve to open. The closure device 24 illustrated in FIG. 2 is of the type known to those skilled in the art as a flapper, but other types of closure devices may be used, such as ball valves, etc.

As depicted, the well tool 20 opens the closure device 24 by pivoting it into an annular chamber 26 surrounding the flow passage 22. However, other methods of opening the closure device 24 could be used in keeping with the principles of the invention. For example, the well tool 20 could engage and displace an opening prong 28 of the safety valve 12, or pressure could be applied to the conduit 18, thereby causing the opening prong to pivot the closure device 24 into the chamber 26.

The opening prong 28 may be otherwise known to those skilled in the art as a flow tube, opening sleeve or operator mandrel. As depicted in FIG. 2, the opening prong 28 has a piston 30 thereon which separates an upper chamber 32 from a lower chamber 34. Pressure applied to the upper chamber 32 (via the conduit 18) biases the piston 30 and opening prong 28 downward against an upwardly directed force exerted by a biasing device 36 (such as a coil spring, pressurized gas, etc.) contained in the lower chamber 34.

It should be understood, however, that the principles of the invention are not limited to the type of safety valve shown in FIG. 2. For example, instead of the annular-shaped piston 30, a piston of the type known to those skilled in the art as a rod piston could be used. Other means of operating the safety valve 12 could be used, such as motors, magnetic couplings, etc.

The well tool 20 illustrated in FIG. 2 includes a container 38. The container 38 has a hardenable fluid 40 therein. The hardenable fluid 40 could be an epoxy (such as a multi-part epoxy), a polymer, a flowable plastic material, a foamed material, a cementitious material, a gel, etc. Preferably, the hardenable fluid 40 is a material which is initially in a flowable state when conveyed into the safety valve 12, and which becomes more rigid after being flowed into the safety valve. The hardenable fluid 40 could be flowed into the safety valve 12, then become more rigid to prevent the safety valve from closing for a desired period of time, and then be degraded (for example, by dissolving the rigid material) to again permit the safety valve to close.

Figure 3:
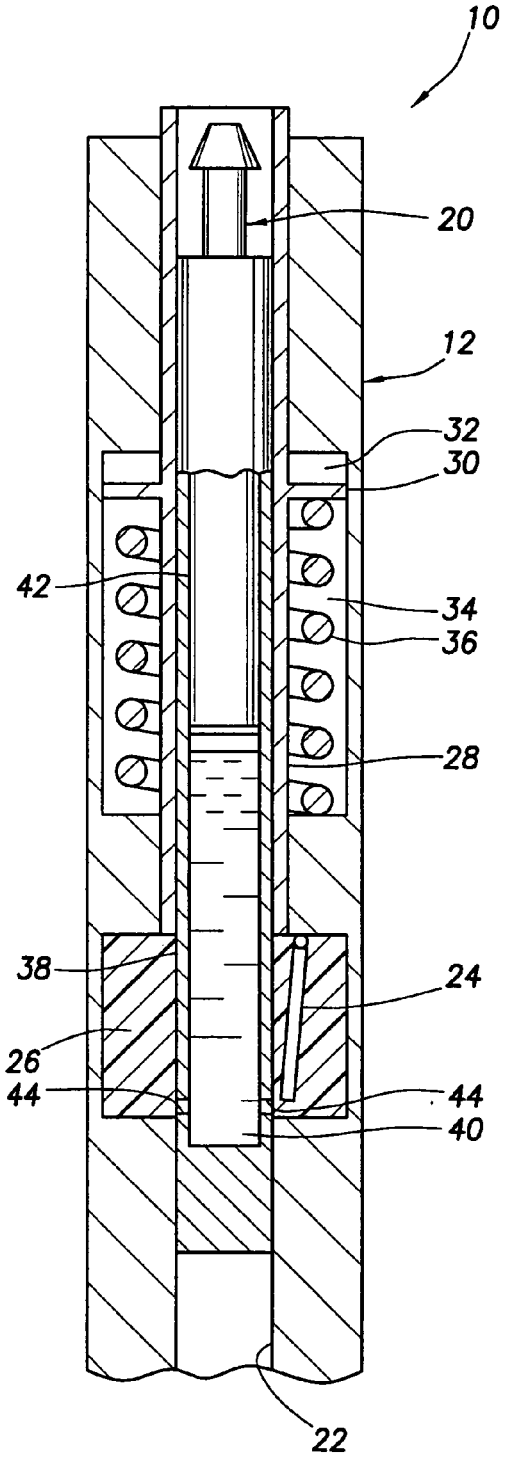
FIG. 3 is an enlarged scale schematic cross-sectional view of an intermediate step in the safety valve lock out method.

Referring additionally now to FIG. 3, the hardenable fluid 40 is shown being transferred from the well tool 20 into the safety valve 12. As illustrated, the hardenable fluid 40 is flowed into the chamber 26 about the closure device 24. A pump or other fluid transfer device 42 of the well tool 20 is used to force the hardenable fluid 40 out of the container 38, through openings 44, and into the chamber 26.

The hardenable fluid 40 is preferably permitted to set, harden, or otherwise become more rigid while the well tool 20 remains positioned in the flow passage 22, so that the flow passage is not obstructed by the hardened fluid. However, this is not necessary in keeping with the principles of the invention.

Figure 4:
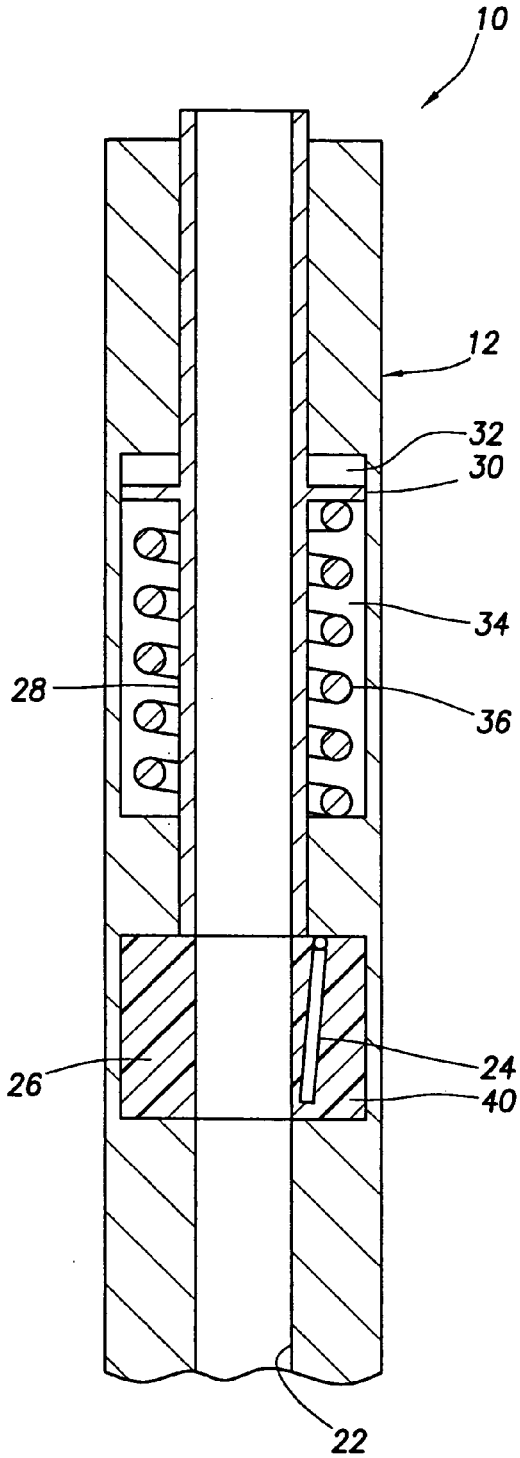
FIG. 4 is an enlarged scale schematic cross-sectional view of a concluding step in the safety valve lock out method.

Referring additionally now to FIG. 4, the safety valve 12 is illustrated after the fluid 40 has hardened and the well tool 20 has been retrieved from the flow passage 22. Note that the closure device 24 is encapsulated by the hardened fluid 40 in the chamber 26, thereby preventing the closure device from closing.

In addition, note that the hardened fluid 40 abuts a lower end of the opening prong 28, thereby preventing displacement of the opening prong. If the opening prong 28 had been in an open position when the hardenable fluid 40 was transferred into the safety valve 12, this feature could be used to prevent the opening prong from displacing away from the open position. Other ways of preventing displacement of the opening prong 28 are described below.

Figure 5:
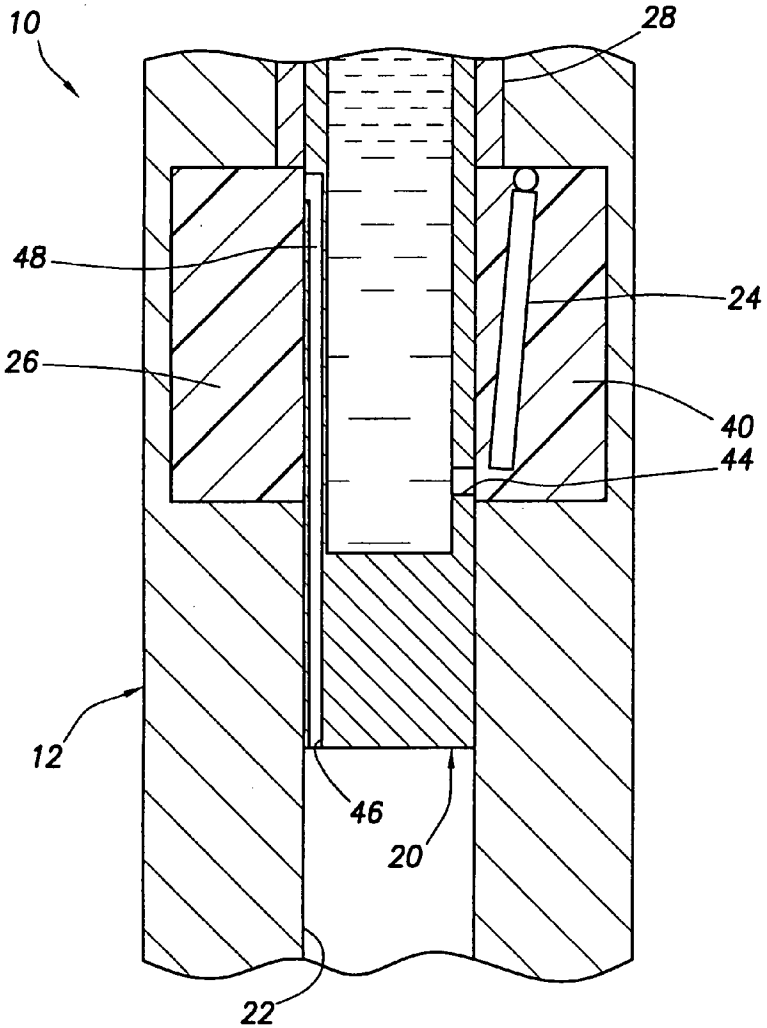
FIG. 5 is an enlarged scale schematic cross-sectional view of an alternate step in the safety valve lock out method.

Referring additionally now to FIG. 5, an alternate step in the method of locking out the safety valve 12 is representatively illustrated in a further enlarged cross-sectional view of a lower portion of the safety valve. It may be desirable to provide a fluid path 46 for fluid 48 initially in the chamber 26 to escape when the hardenable fluid 40 is transferred from the well tool 20 to the chamber. In this manner, the hardenable fluid 40 will be exchanged for the fluid 48 initially in the chamber 26.

As depicted in FIG. 5, the fluid path 46 is formed in the well tool 20. The fluid path 46 extends from the chamber 26 to the flow passage 22 below the well tool 20. Thus, when the hardenable fluid 40 is displaced by the pump 42 into the chamber 26, the fluid 48 initially in the chamber will be displaced into the flow passage 22 below the well tool 20. Note that the well tool 20 could be sealed in the flow passage 22 above and below the chamber 26 to enhance this exchange of the fluids 40, 48, if desired.

Figure 6:
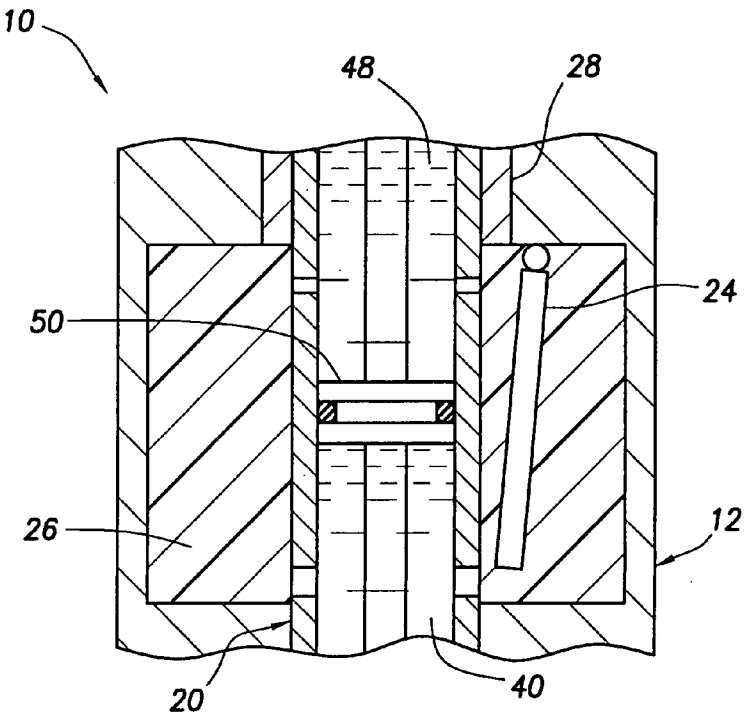
FIG. 6 is an enlarged scale schematic cross-sectional view of another alternate step in the safety valve lock out method.

Referring additionally now to FIG. 6, another manner of exchanging the fluids 40, 48 is representatively illustrated. In this view it may be seen that an alternate configuration of the pump 42 includes a piston 50. As the piston 50 is displaced downwardly in the container 38, the hardenable fluid 40 is displaced into the chamber 26 while the fluid 48 initially in the chamber is received into the container above the piston. Thus, the downward displacement of the piston 50 causes the hardenable fluid 40 to flow into the chamber, and also causes the fluid 48 to be flowed into the well tool 20.

Figure 7:
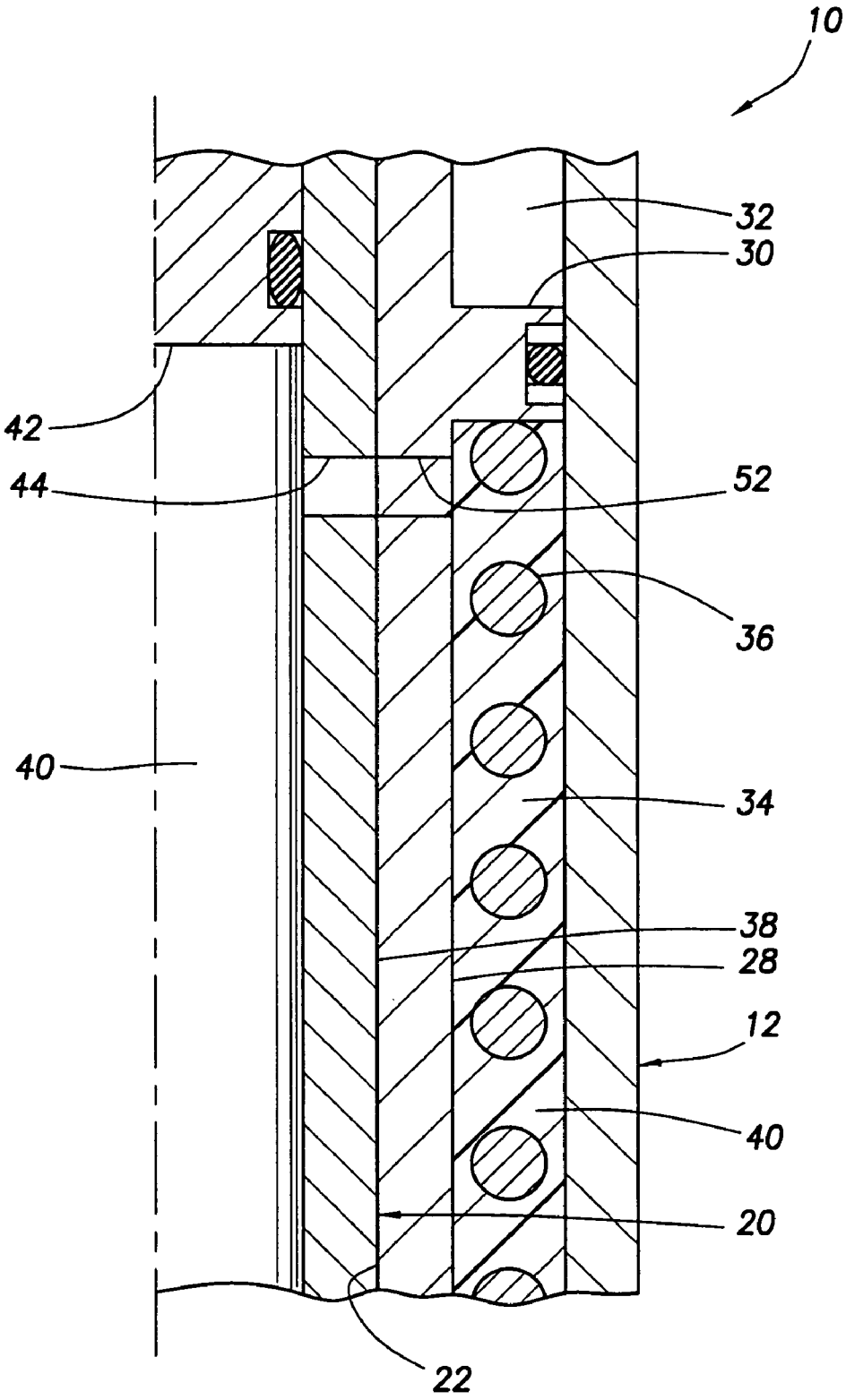
FIG. 7 is an enlarged scale schematic cross-sectional view of yet another alternate step in the safety valve lock out method.

Referring additionally now to FIG. 7, another method of flowing the hardenable fluid 40 into the safety valve 12 is representatively illustrated. In this method, the hardenable fluid 40 is instead flowed into the chamber 34 below the piston 30 on the opening prong 28. For example, the opening 44 may be repositioned so that it is aligned with an opening 52 formed through a sidewall of the opening prong between the flow passage 22 and the chamber 34.

Thus, when the pump 42 displaces the hardenable fluid 40 out of the container 38 through the opening 44, the hardenable fluid will pass through the opening 52 into the chamber 34 about the biasing device 36. When the fluid 40 hardens (or at least becomes more rigid), the biasing device 36 will be prevented from biasing the opening prong 28 upward. This will prevent upward displacement of the opening prong 28, for example, if the opening prong is in its open position when the fluid 40 is flowed into the chamber 34, thereby preventing the closure device 24 from closing.

Note that the hardenable fluid 40 could in a similar manner be flowed into the chamber 32 above the piston 30, for example, by providing an opening (similar to the opening 52) in the sidewall of the opening prong 28 above the piston 30. When the fluid 40 in the chamber 32 hardens (or at least becomes more rigid), it will prevent upward displacement of the opening prong 28, thereby preventing the closure device 24 from closing if the opening prong is in its open position.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method of locking out a safety valve in a subterranean well, the method comprising the steps of:

flowing a hardenable fluid into the safety valve; and preventing a closure device of the safety valve from closing with the hardenable fluid, the closure device being prevented from closing when the hardenable fluid has hardened.

2. The method of claim 1, wherein the flowing step further comprises flowing the hardenable fluid about the closure device.

3. The method of claim 1, wherein the flowing step further comprises encapsulating the closure device with the hardenable fluid.

4. The method of claim 1, wherein the flowing step further comprises flowing the hardenable fluid about a biasing device of the safety valve.

5. The method of claim 1, wherein the flowing step further comprises flowing the hardenable fluid into an internal chamber of the safety valve.

6. The method of claim 5, wherein the flowing step further comprises exchanging the hardenable fluid for a fluid initially in the internal chamber.

7. The method of claim 5, wherein in the flowing step, the internal chamber contains a biasing device.

8. The method of claim 5, wherein in the flowing step, the internal chamber is in communication with a fluid conduit extending to a remote location.

9. The method of claim 1, wherein the preventing step further comprises preventing displacement of an opening prong of the safety valve.

10. The method of claim 1, wherein the flowing step further comprises positioning a well tool containing the hardenable fluid within a flow passage of the safety valve, and transferring the hardenable fluid from the well tool to the safety valve.

11. A system for locking out a safety valve positioned in a subterranean well, the system comprising:

a container having a hardenable fluid therein; and a fluid transfer device for transferring the hardenable fluid from the container to the safety valve to prevent a closure member of the safety valve from closing, the closure device being prevented from closing when the hardenable fluid has hardened.

12. The system of claim 11, wherein the container and fluid transfer device are configured to flow the hardenable fluid about the closure member.

13. The system of claim 11, wherein the container and fluid transfer device are configured to encapsulate the closure member with the hardenable fluid.

14. The system of claim 11, wherein the container and fluid transfer device are configured to flow the hardenable fluid about a biasing device of the safety valve.

15. The system of claim 11, wherein the container and fluid transfer device are configured to flow the hardenable fluid into an internal chamber of the safety valve.

16. The system of claim 15, wherein the internal chamber is in communication with a fluid conduit extending to a remote location.

17. The system of claim 15, wherein a biasing device is contained within the internal chamber.

18. The system of claim 15, wherein the closure device is contained within the internal chamber.

19. The system of claim 15, wherein the fluid transfer device exchanges the hardenable fluid for fluid initially in the internal chamber.

20. The system of claim 11, wherein the container and fluid transfer device are configured to flow the hardenable fluid into a position preventing displacement of an opening prong of the safety valve.

21. The system of claim 11, wherein the hardenable fluid is an epoxy.

22. The system of claim 21, wherein the epoxy is a multi-part epoxy.

23. The system of claim 11, wherein the hardenable fluid is a polymer.

24. The system of claim 11, wherein the hardenable fluid is a flowable plastic material.

25. The system of claim 11, wherein the hardenable fluid is a foamed material.

26. The system of claim 11, wherein the hardenable fluid is cementitious material.

27. The system of claim 11, wherein the hardenable fluid is a gel.

28. The system of claim 11, wherein the hardenable fluid is dissolvable for temporary locking out of the safety valve.

29. A system for locking out a safety valve positioned in a subterranean well, the system comprising:

a container having a hardenable fluid therein; and a fluid transfer device for transferring the hardenable fluid from the container to the safety valve to prevent a closure member of the safety valve from closing, and wherein the container and fluid transfer device are included in a well tool receivable within a flow passage of the safety valve.

30. The system of claim 29, wherein the well tool opens the closure device when the well tool is received in the flow passage.

31. A system for locking out a safety valve positioned in a subterranean well, the system comprising:

a container having a hardenable fluid therein; and a fluid transfer device for transferring the hardenable fluid from the container to the safety valve to prevent a closure member of the safety valve from closing, wherein the container and fluid transfer device are configured to flow the hardenable fluid into an internal chamber of the safety valve, wherein the fluid transfer device exchanges the hardenable fluid for fluid initially in the internal chamber, and wherein the fluid initially in the internal chamber is received into a well tool which includes the container when the hardenable fluid is flowed into the internal chamber.

* * * * *